US009287643B2

(12) United States Patent
Yoshida

(10) Patent No.: US 9,287,643 B2
(45) Date of Patent: Mar. 15, 2016

(54) ELECTRIC CONNECTOR

(71) Applicant: ACES ELECTRONICS CO., LTD., Zhongli, Taoyuan County (TW)

(72) Inventor: Norio Yoshida, Atsugi (JP)

(73) Assignee: ACES ELECTRONICS CO., LTD., Zhongli, Taoyuan County (TW)

( * ) Notice: Subject to any disclaimer, the term of this patent is extended or adjusted under 35 U.S.C. 154(b) by 0 days.

(21) Appl. No.: 14/459,448

(22) Filed: Aug. 14, 2014

(65) Prior Publication Data

US 2015/0056869 A1 Feb. 26, 2015

(30) Foreign Application Priority Data

Aug. 21, 2013 (JP) ..... 2013-171060

(51) Int. Cl.
*H01R 12/75* (2011.01)
*H01R 12/71* (2011.01)
*H01R 13/627* (2006.01)

(52) U.S. Cl.
CPC ..... *H01R 12/75* (2013.01); *H01R 12/716* (2013.01); *H01R 13/6275* (2013.01)

(58) Field of Classification Search
CPC ... H01R 12/75; H01R 12/716; H01R 13/6275
See application file for complete search history.

(56) References Cited

U.S. PATENT DOCUMENTS 4,632,475 A * 12/1986 Tomita ..... H01R 35/04 439/1
5,486,118 A * 1/1996 Colleran ..... H01R 13/436 439/374
5,674,078 A * 10/1997 Davis ..... H01R 23/70 439/79
5,902,146 A * 5/1999 Hanami ..... H01R 12/79 439/405
6,213,810 B1 * 4/2001 Okano ..... H01R 12/592 439/495
6,461,178 B1 * 10/2002 Fu ..... H01R 31/06 439/224
6,500,013 B1 * 12/2002 Wang ..... H01R 12/598 439/108
6,692,294 B2 * 2/2004 Kobayashi ..... H01R 12/79 439/496
6,733,301 B2 * 5/2004 Brown, III ..... H01R 12/585 439/65
6,830,478 B1 * 12/2004 Ko ..... H01R 13/6275 439/484
6,908,345 B2 * 6/2005 Shimizu ..... H01R 13/62905 439/342
6,974,344 B2 * 12/2005 Comerci ..... H01R 23/661 439/329
7,070,465 B2 * 7/2006 Masaki ..... H01R 12/75 439/850

(Continued)

FOREIGN PATENT DOCUMENTS

JP 2006128033 A 5/2006

*Primary Examiner* — Ross Gushi
(74) *Attorney, Agent, or Firm* — Chiesa Shahinian & Giantomasi PC

(57) ABSTRACT

An electric connector includes a first connector, and a second connector, wherein the first connector includes a first housing, a plurality of first contacts, and first lock metal fittings, the second connector includes a second housing, a plurality of second contacts, and a second lock metal fitting, an electric wires are inserted into the second connector in a direction parallel to a circuit board surface, and in a direction perpendicular to an arranging direction of the second contacts, and the second lock metal fitting includes lock engaging portions provided at both ends of the arranging direction of the second contacts of the second housing, and a coupling portion coupling the lock engaging portions at least at a side of a removing direction of the second connector of the electric wires at an insertion side of the electric wires of the second housing.

4 Claims, 7 Drawing Sheets

(56) References Cited

U.S. PATENT DOCUMENTS 7,094,092 B2 * 8/2006 Yang ..... H01R 13/6593 439/495
7,112,102 B2 * 9/2006 Masaki ..... H01R 12/75 439/660
7,118,424 B2 * 10/2006 Masaki ..... H01R 12/75 439/682
7,121,848 B2 * 10/2006 Ono ..... H01R 12/57 439/682
7,134,907 B2 * 11/2006 Watanabe ..... H01R 12/775 439/495
7,207,842 B1 * 4/2007 Kenjo ..... H01R 9/0515 439/607.01
7,220,146 B2 * 5/2007 Miyazaki ..... H01R 9/0527 439/402
7,303,444 B2 * 12/2007 Denpouya ..... H01R 13/629 439/660
7,314,377 B2 * 1/2008 Northey ..... H01R 12/777 439/79
7,331,812 B2 * 2/2008 Nishio ..... H01R 13/639 439/331
7,354,313 B2 * 4/2008 Kumazawa ..... G02B 6/3897 439/638
7,367,820 B2 * 5/2008 Kikuchi ..... H01R 12/592 439/108
7,377,803 B2 * 5/2008 Matsuoka ..... H01R 12/592 439/497
7,422,451 B2 * 9/2008 Chen ..... H01R 13/652 439/101
7,430,801 B2 * 10/2008 Iida ..... H01R 43/16 29/883
7,553,167 B2 * 6/2009 Zhang ..... H01R 4/2433 439/497
7,607,943 B2 * 10/2009 Kenjo ..... H01R 12/62 439/579
7,722,387 B2 * 5/2010 Yamaji ..... H01R 12/716 439/497
7,802,994 B1 * 9/2010 Chen ..... H01R 12/58 439/65
7,815,467 B2 * 10/2010 Tsuchida ..... H01R 21/716 439/579
7,828,585 B2 * 11/2010 Kurimoto ..... H01R 13/02 439/357
7,833,042 B2 * 11/2010 Nishio ..... G02B 6/4201 439/160
7,878,843 B2 * 2/2011 Zhang ..... H01R 23/661 439/497
7,883,364 B2 * 2/2011 Wu ..... H01R 9/032 439/578
7,927,122 B2 * 4/2011 Yamaji ..... H01R 9/0515 439/342
7,946,882 B2 * 5/2011 Wu ..... H01R 13/648 439/108
8,043,114 B2 * 10/2011 Kaneko ..... H01R 13/65802 439/468
8,075,324 B2 * 12/2011 Yamaji ..... H01R 13/6295 439/188
8,137,128 B2 * 3/2012 Hsueh ..... H01R 9/03 439/499
8,147,269 B2 * 4/2012 Yamaji ..... H01R 13/629 439/372
8,206,159 B2 * 6/2012 Naito ..... H01R 12/7082 439/65
8,226,432 B2 * 7/2012 Hsueh ..... H01R 9/03 439/497
8,317,535 B2 * 11/2012 Yasui ..... H01R 12/724 439/378
8,333,621 B2 * 12/2012 Chen ..... H01R 9/24 439/746
8,337,259 B2 * 12/2012 Chen ..... H01R 13/432 439/751
8,388,370 B2 * 3/2013 Yamaji ..... H01R 13/62994 439/497
8,523,603 B2 * 9/2013 Yamaji ..... H01R 12/57 439/493
8,550,849 B2 * 10/2013 Yamaji ..... H01R 13/6581 439/495
8,591,256 B2 * 11/2013 Kobayashi ..... H01R 13/4223 439/595
8,602,812 B2 * 12/2013 Ohsaka ..... H01R 12/775 439/497
8,727,803 B2 * 5/2014 Kurachi ..... H01R 12/88 439/497
8,727,813 B2 * 5/2014 Yang ..... H01R 12/732 439/500
8,882,527 B1 * 11/2014 Chiang ..... H01R 13/641 439/354
9,048,569 B2 * 6/2015 Chen ..... H01R 12/716
2004/0002265 A1 * 1/2004 Shimizu ..... H01R 13/62905 439/660
2005/0037653 A1 * 2/2005 Comerci ..... H01R 23/661 439/329
2005/0186855 A1 * 8/2005 Shimizu ..... H01R 12/716 439/682
2006/0094304 A1 * 5/2006 Masaki ..... H01R 12/75 439/850
2006/0094306 A1 * 5/2006 Masaki ..... H01R 12/75 439/850
2006/0270283 A1 * 11/2006 Kumazawa ..... G02B 6/3897 439/676
2007/0123089 A1 * 5/2007 Nishio ..... H01R 13/639 439/342
2008/0293286 A1 * 11/2008 Denpouya ..... H01R 13/4367 439/358
2010/0210130 A1 * 8/2010 Yamaji ..... H01R 13/6295 439/352
2010/0291787 A1 * 11/2010 Kuo ..... H01R 12/79 439/352
2011/0151708 A1 * 6/2011 Kaneko ..... H01R 13/65802 439/404
2011/0256740 A1 * 10/2011 Naito ..... H01R 12/7082 439/65
2011/0256778 A1 * 10/2011 Chen ..... H01R 9/24 439/668
2012/0077365 A1 * 3/2012 Kobayashi ..... H01R 13/4223 439/345
2012/0135642 A1 * 5/2012 Chang ..... H01R 9/032 439/630
2013/0090018 A1 * 4/2013 Chiang ..... H01R 13/6271 439/660
2013/0143444 A1 * 6/2013 Chen ..... H01R 13/518 439/626
2014/0187085 A1 * 7/2014 Nishimura ..... H01R 13/6273 439/578
2015/0004844 A1 * 1/2015 Naganawa ..... H01R 13/516 439/626
2015/0056869 A1 * 2/2015 Yoshida ..... H01R 12/75 439/694

* cited by examiner

ELECTRIC CONNECTOR

CROSS-REFERENCE TO RELATED APPLICATIONS

This application claims priority to Japanese Patent Application No. 2013-171060, filed on Aug. 21, 2013, which is incorporated herein by reference in its entirety.

BACKGROUND OF THE INVENTION

The present invention relates to an electric connector that connects an electric wire and a board.

Typically, there are electric connectors including a base connector including a resin housing mounted on a circuit board, and a socket connector including a resin housing fit into the base connector in a direction perpendicular to the circuit board (e.g., see JP 2006-128033 A). According to the electric connectors, the socket connector can be locked in the base connector by use of friction between the housings.

However, in the above electric connectors, the housings are made of a resin, and thus the housings are worn away due to repetitive insertion and removal of the connectors, and lock strength becomes weak.

SUMMARY OF THE INVENTION

An objective of the present invention is to provide an electric connector having large lock strength.

An electric connector of the present invention includes a first connector mounted on a circuit board surface, and a second connector connected to electric wires, wherein the first connector includes a first housing including an insertion portion into which the second connector is inserted from a direction perpendicular to the circuit board surface, a plurality of first contacts arranged in the insertion portion, and first lock metal fittings provided at both ends of an arranging direction of the first contacts of the first housing, having elasticity, and preventing removal of the second connector, the second connector includes a second housing inserted into the insertion portion of the first connector, a plurality of second contacts connected to the plurality of first contacts, and a second lock metal fitting engaged with the first lock metal fittings, the electric wires are inserted into the second connector in a direction parallel to the circuit board surface, and in a direction perpendicular to an arranging direction of the second contacts, and the second lock metal fitting includes lock engaging portions provided at both ends of the arranging direction of the second contacts of the second housing, and a coupling portion coupling the lock engaging portions at least at a side of a removing direction of the second connector of the electric wires at an insertion side of the electric wires of the second housing.

Further, the electric connector of the present invention may have the coupling portion include openings into which the electric wires are inserted.

Further, the electric connector of the present invention may have the second lock metal fitting insert-molded into the second housing.

According to the present invention, an electric connector having large lock strength can be provided.

DETAILED DESCRIPTION

Figure 1:
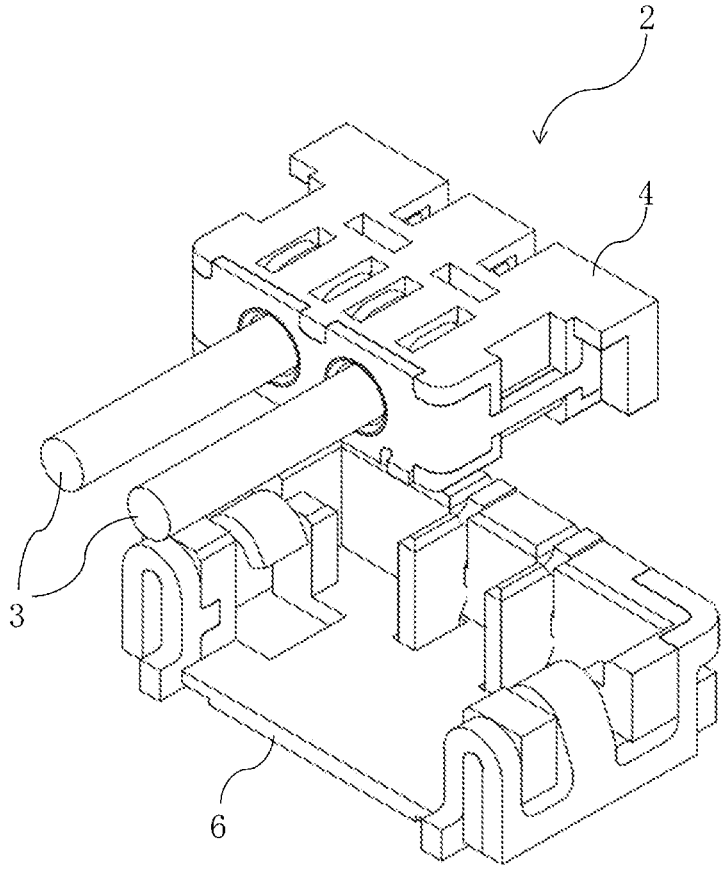
FIG. 1 is a perspective view of an electric connector according to an embodiment.

An electric connector according to an embodiment of the present invention will be herein described with reference to the drawings. FIG. 1 is a perspective view of an electric connector according to an embodiment. As illustrated in FIG. 1, an electric connector 2 includes an electric wire-side connector 4 connected to electric wires 3, and a board-side connector 6 mounted on a circuit board surface (not illustrated).

Figure 2:
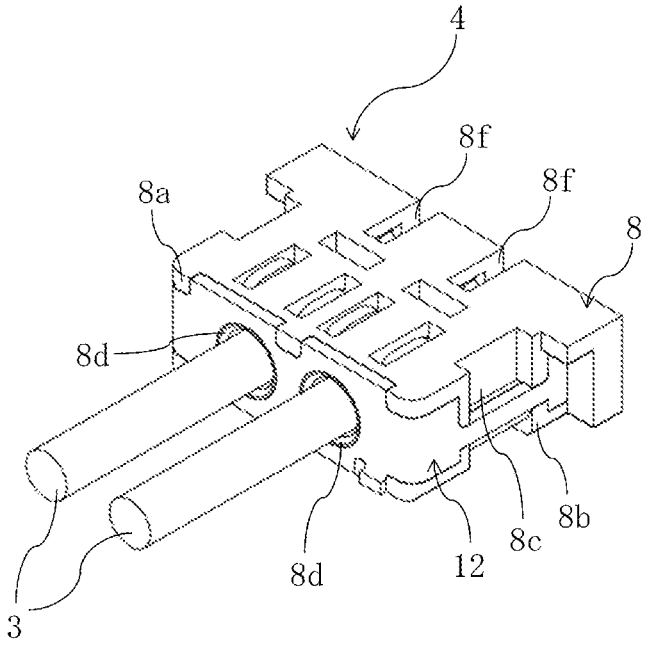
FIG. 2 is a perspective view of an electric wire-side connector according to the embodiment.
Figure 3:
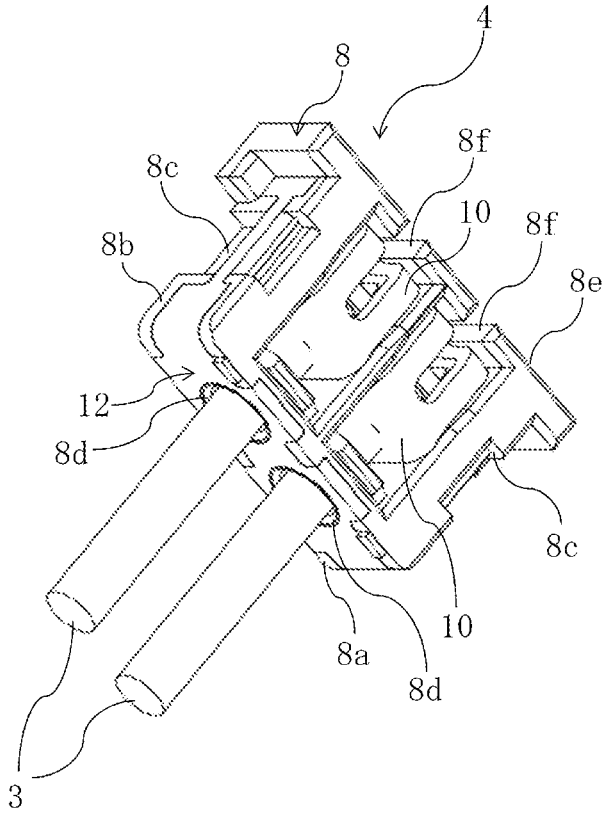
FIG. 3 is a perspective view of the electric wire-side connector according to the embodiment.

FIG. 2 is a perspective view of the electric wire-side connector 4 as viewed from above, and FIG. 3 is a perspective view of the electric wire-side connector 4 as viewed from below. As illustrated in FIGS. 2 and 3, the electric wire-side connector 4 includes a rectangular parallelepiped housing 8 inserted into the board-side connector 6 in a direction (hereinafter, referred to as board perpendicular direction) perpendicular to the circuit board surface. Here, the housing 8 is formed of a resin member having insulation properties.

Further, a plurality of electric wire-side contacts 10, which is electrically connected to board-side contacts 20 (see FIG. 5) when the electric wire-side connector 4 is fit into the board-side connector 6, is arranged inside the housing 8. Further, an electric wire-side lock metal fitting 12 to be engaged with board-side lock metal fittings 22 (see FIG. 5) is insert-molded into the housing 8.

Figure 4:
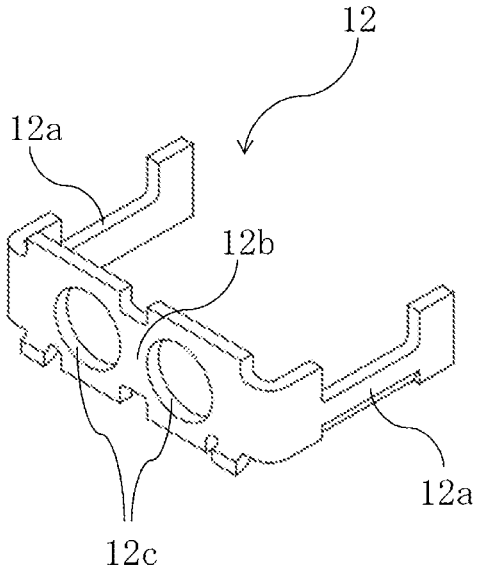
FIG. 4 is a perspective view of an electric wire-side lock metal fitting according to the embodiment.

FIG. 4 is a perspective view illustrating the electric wire-side lock metal fitting 12. As illustrated in FIG. 4, the electric wire-side lock metal fitting 12 is provided with lock engaging portions 12*a* positioned at both end portions 8*b* of an arranging direction (hereinafter, referred to as contact arranging direction) of the electric wire-side contacts 10 of the housing 8, and for engaging the board-side lock metal fittings 22. Further, the electric wire-side lock metal fitting 12 is provided with a coupling portion 12*b* positioned at an end portion 8*a* of a side (hereinafter, referred to as electric wire insertion-side) into which the electric wires 3 of the housing 8 are inserted, and for coupling the lock engaging portions 12*a*. Further, openings 12*c* for allowing the electric wires 3 to be inserted are formed in the coupling portion 12*b*.

Further, grooves 8*c* extending in the board perpendicular direction are formed in the both end portions 8*b* of the housing 8. The lock engaging portions 12*a* of the electric wire-side lock metal fitting 12 are exposed at the grooves 8*c*. Further, openings 8*d* for allowing the electric wires 3 to be inserted, the electric wires 3 being connected to the electric wire-side contacts 10, are formed in the end portion 8*a* of the housing 8. Further, notched portions 8*f* into which the board-side contacts 20 are fit are formed in an end portion 8*e* at a side opposite to the end portion 8*a* of the housing 8.

Figure 5:
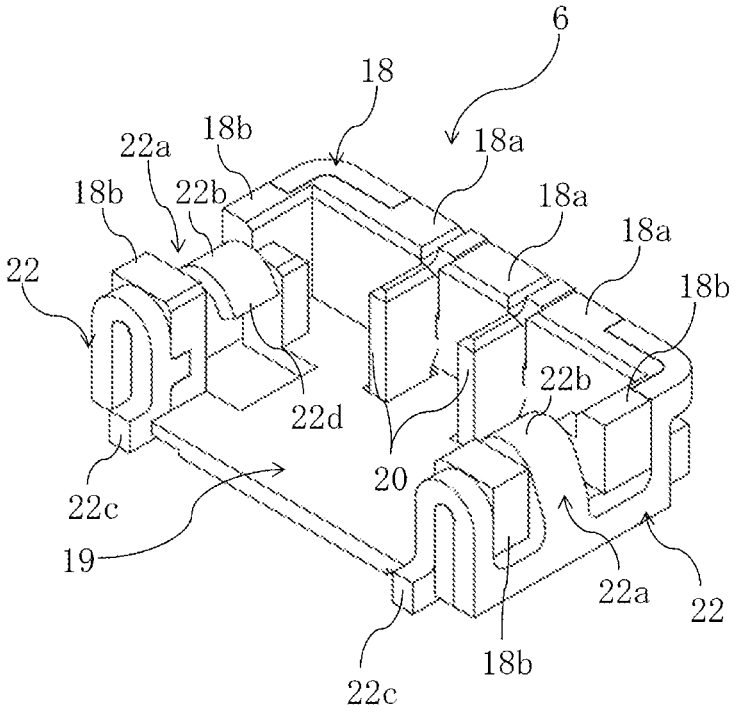
FIG. 5 is a perspective view of a board-side connector according to the embodiment.

FIG. 5 is a perspective view of the board-side connector 6. As illustrated in FIG. 5, the board-side connector 6 includes a rectangular parallelepiped housing 18 made of a resin member having insulation properties. Here, a square insertion recessed portion 19 for accepting the electric wire-side connector 4 inserted from the board perpendicular direction is formed in the housing 18. The insertion recessed portion 19 is a recessed space surrounded by a wall portion 18*a* formed at a side opposite to the electric wire insertion-side, and a pair of wall portions 18*b* formed at both end portions of the contact arranging direction.

Further, a plurality of the flat plate type board-side contacts 20 is arranged in the insertion recessed portion 19. Further, the board-side lock metal fittings 22 for preventing removal of the electric wire-side connector 4 from the board-side connector 6 are insert-molded into the housing 18.

Here, engaging portions 22*a* positioned at the pair of wall portions 18*b*, respectively, and engaged with the lock engaging portions 12*a* of the electric wire-side lock metal fitting 12 are provided in the board-side lock metal fittings 22. Bending portions 22*b* bending toward the insertion recessed portion 19 and having elasticity are provided at upper ends of the engaging portions 22*a*. Further, fixing portions 22*c* for fixing the board-side lock metal fittings 22 to the circuit board is provided at a side of the circuit board surface of the board-side lock metal fittings 22.

Figure 6:
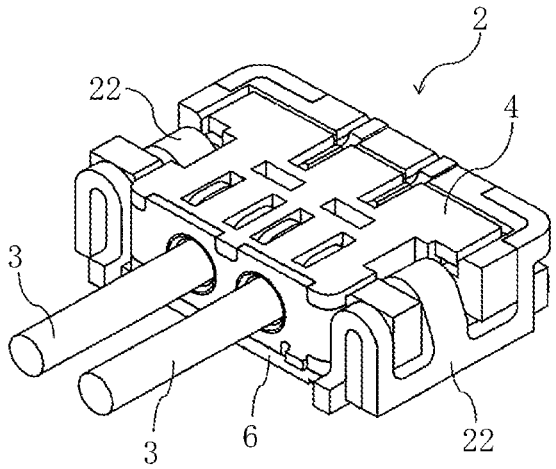
FIG. 6 is a perspective view indicating a state in which the electric wire-side connector and the board-side connector according to the embodiment are fit.
Figure 7:
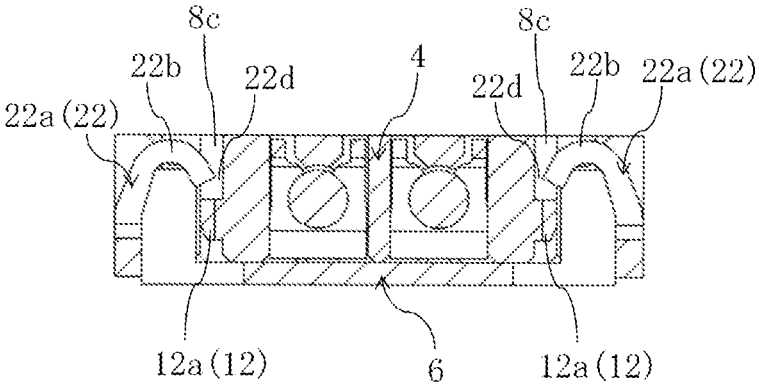
FIG. 7 is a cross sectional view indicating a state in which the electric wire-side connector and the board-side connector according to the embodiment are fit.

FIG. 6 is a perspective view illustrating a state in which the electric wire-side connector 4 and the board-side connector 6 according to an embodiment are fit, and FIG. 7 is a diagram illustrating a cross section of the state. When the electric wire-side connector 4 is inserted into the insertion recessed portion 19 of the board-side connector 6, and the electric wire-side connector 4 is pressed downward, lower surfaces of the lock engaging portions 12*a* come in contact with upper surfaces of the bending portions 22*b*. When the electric wire-side connector 4 is further pressed down, the bending portions 22*b* are pressed and extended in outer side directions of the insertion recessed portion 19, and the lock engaging portions 12*a* are moved to lower sides of tip portions 22*d* of the bending portions 22*b*. In this case, the tip portions 22*d* are returned inside the insertion recessed portion 19 due to elastic force of the bending portions 22*b*, and the tip portions 22*d* becomes in a state of being positioned at upper sides of the lock engaging portions 12*a*.

Accordingly, upper surfaces of the lock engaging portions 12*a* are engaged with the tip portions 22*d* of the bending portions 22*b*, and the electric wire-side connector 4 is locked with the board-side connector 6. Therefore, removal of the electric wire-side connector 4 from the board-side connector 6 can be prevented.

According to the electric connector 2 of the embodiment, the electric wire-side connector 4 includes the electric wire-side lock metal fitting 12, and the board-side connector 6 includes the board-side lock metal fittings 22. When the electric wire-side connector 4 is fit into the board-side connector 6, the upper surfaces of the lock engaging portions 12*a* are engaged with the tip portions 22*d* of the bending portions 22*b*, and thus the lock intensity of the electric connector 2 can be improved.

Further, the electric wire-side lock metal fitting 12 and the board-side lock metal fittings 22 are formed of metal. Therefore, even if insertion and removal of the electric connector 2 is repeated, these fittings are not worn away, and can maintain the lock intensity of the electric connector 2 through a long period of time.

Further, the electric wires 3 are inserted into the openings 12*c* of the electric wire-side lock metal fitting 12, and the end portion 8*a* of the housing 8 is protected by the electric wire-side lock metal fitting 12. Therefore, when the electric wires 3 are pulled and the electric wire-side connector 4 is taken out from the board-side connector 6, breakage of the housing 8 due to the electric wires 3 can be prevented.

Note that, in the above-described embodiment, the openings 12*c* that allow the electric wires 3 to be inserted are formed in the coupling portion 12*b* of the electric wire-side lock metal fitting 12. However, the coupling portion of the electric wire-side lock metal fitting may have a shape to couple both-side lock engaging portions at an upper side than the electric wires 3.

The above-described embodiment is provided for easy understanding of the invention and thus is not construed to limit the invention. Accordingly, each element disclosed in the above embodiment includes design modifications and equivalents within the technical scope of the invention.

The invention claimed is:

1. An electric connector comprising:

a first connector mounted on a circuit board surface; and a second connector connected to electric wires, wherein the first connector includes a first housing including an insertion portion into which the second connector is inserted from a direction perpendicular to the circuit board surface, a plurality of first contacts arranged in the insertion portion, and first lock metal fittings provided at both ends of an arranging direction of the first contacts of the first housing, having elasticity, and preventing removal of the second connector, the second connector includes a second housing inserted into the insertion portion of the first connector, a plurality of second contacts connected to the plurality of first contacts, and a second lock metal fitting engaged with the first lock metal fittings, the electric wires are inserted into the second connector in a direction parallel to the circuit board surface, and in a direction perpendicular to an arranging direction of the second contacts, and the second lock metal fitting includes lock engaging portions provided at both ends of the arranging direction of the second contacts of the second housing, and a coupling portion coupling the lock engaging portions at a side of the second housing in which the electric wires are inserted.

2. The electric connector according to claim 1, wherein the coupling portion includes openings into which the electric wires are inserted.

3. The electric connector according to claim 2, wherein the second lock metal fitting is insert-molded into the second housing.

4. The electric connector according to claim 1, wherein the second lock metal fitting is insert-molded into the second housing.

* * * * *